United States Patent [19]

McKenna

[11] Patent Number: 4,523,703

[45] Date of Patent: Jun. 18, 1985

[54] COAT PACK

[76] Inventor: George T. McKenna, 3238 Federal Cir., Broomfield, Colo. 80020

[21] Appl. No.: 569,387

[22] Filed: Jan. 9, 1984

[51] Int. Cl.[3] ..... A45F 3/00

[52] U.S. Cl. ..... 224/224; 224/227; 224/228; D2/383

[58] Field of Search ..... 224/224, 227, 228, 229, 224/904, 249, 191, 235, 236, 240; D2/380, 381, 383, 393, 400

[56] References Cited

U.S. PATENT DOCUMENTS

| | | | |
|---|---|---|---|
| D. 261,196 | 10/1981 | Griffin | D2/383 |
| 4,029,243 | 6/1977 | Zerobnick et al. | 224/224 |
| 4,244,499 | 1/1981 | Adams | 224/224 |

FOREIGN PATENT DOCUMENTS 238070 6/1945 Switzerland .

*Primary Examiner*—Stephen Marcus

*Assistant Examiner*—David Voorhees

*Attorney, Agent, or Firm*—Kyle W. Rost

[57] ABSTRACT

A torso-encircling carrier is provided with a tubular body having a central closed tubular portion and two opposite end tapered tubular portions, each end portion having a closure means that can be opened to permit through passage of a carried object such as a coat. The tubular body is formed from a panel of sheet material having the shape of a double trapezoid, wherein the two trapezoids are joined at a common major base defining the length of the body, and the major base of each trapezoid is opposed by a minor base, the minor bases being joined commonly to define the central closed tubular portion of the body. The angled sides of the trapezoids on each common end of the common base define the tapered end portions of the body. A filler strip may be the common attachment of the minor bases and may include end portions that provide zipper closures and self-closing flaps over the zippers.

6 Claims, 6 Drawing Figures

COAT PACK

BACKGROUND OF THE INVENTION

1. Field of the Invention

The invention relates generally to package and article carriers and especially to carriers carried by an animate bearer. The receiver is permanently mounted on or formed as part of a torso-encircling carrier.

2. Description of the Prior Art

One popular type of carrier or pack, commonly referred to as a "fanny pack," is particularly convenient for outdoor activities where freedom of movement is desired. Common designs provide a pack of uniform height across the width of the pack, although the front-to-rear contour of the pack may vary to conform to the anticipated curve of the user's back. Access to the receiver compartment is by a single horizontal transverse zipper or the like for each compartment.

One particular problem of the art addressed by the present invention is the poor ability of known fanny packs to accommodate coats, which, because of their bulk and length, are difficult to compress into a top loading volume as found in the typical fanny pack. Yet, in some of the most common situations where a fanny pack is desirable, such as in skiing and hiking, a coat is one of the most common items to be carried in reserve.

Another problem addressed by the present invention is weight distribution and conformity to body shape of the pack. The typical fanny pack is carried almost entirely on the wearer's back side and may project in a manner that causes discomfort when the pack is heavily loaded. Also because the volume of the pack is concentrated, a typical fanny pack may project by a considerable distance when completely filled. Those two conditions are sources of bother and discomfort, especially when the wearer is engaged in an active sport.

These and other problems and disadvantages are overcome by the present invention.

SUMMARY OF THE INVENTION

In a torso-encircling carrier such as a coat pack, an elongated tubular body having a tapered tubular body portion at each end is provided with closure means associated with each of the tapered ends for permitting throughput, in use, of a carried object between the opposite closure means. A fastening means such as a belt or buckle is releasibly attached to the opposite ends of the body to form a closed figure that is wearable in a body-encircling manner.

The closure means may comprise a zipper in each tapered end of the body, the two zippers being separated by a central tubular body portion that retains the integrity of the tube when the zippers are open.

The tubular body is preferred to be formed from a panel of sheet material in the approximate shape of a double trapezoid that is joined at a common base defining the longitudinal dimension of the body, each trapezoid also having a minor base providing an attachable edge for closing the center part of the tube when the attachable edges are commonly connected. The angled trapezoidal sides at a common end of both trapezoids define a tapered tube end, each of the opposite tapered tube ends being associated with a closure means for releasible closing the sides.

A filler strip having a central panel may be the common junction between the minor bases of the trapezoids, and a pair of opposite end panels on the filler strip may cover the angled trapezoidal sides of the sheet material to protect the closure means.

DESCRIPTION OF THE PREFERRED EMBODIMENT

Figure 1:
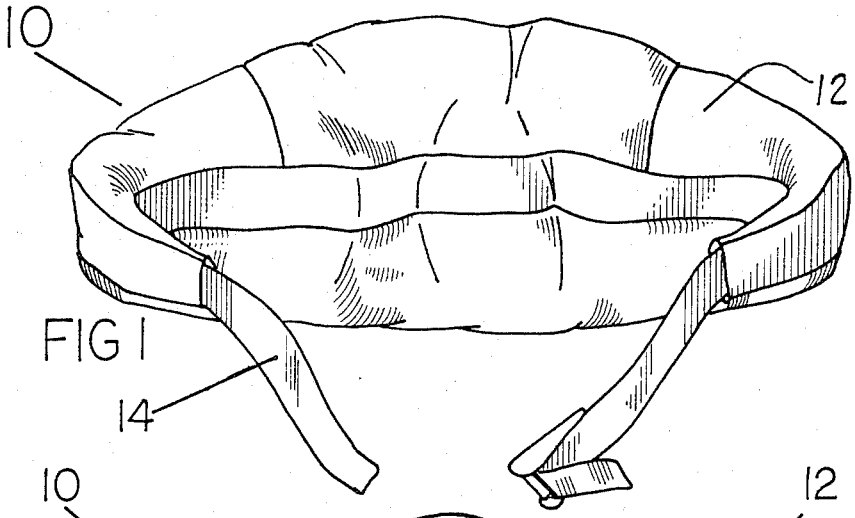
FIG. 1 is a front view of the coat pack.

With reference to FIGS. 1–4, a torso-encircling carrier is shown that is much like a typical fanny pack in the manner of its attachment to a wearer's waist. However, because of the unique capabilities of this carrier or pack to accommodate coats and the like, this pack will be referred to as coat pack 10. The primary components of the coat pack include a tubular body 12 that is adapted to encircle the torso of the wearer, and a means to fasten together the ends of the body 12, such as a belt 14.

Tubular body 12 has a structure that is especially adapted to permit a coat to be easily inserted or withdrawn from its major compartment. In addition, body 12 is configured to spread its load over a large surface area of the wearer's body while remaining uniquely out-of-the-way so that mobility is not impared. This structure includes a double taper ended design such that the body tapers toward each of the opposite tube ends. Thus, the body may be said to have a central tubular portion and a pair of opposite tapering portions continuing from the central portion toward the opposite ends of the body. In each of the tapering portions, generally following the longitudinal axis of the tube, is an elongated end closure such as a zipper 16. When both zippers 16 are open, the body retains the integrity of the tube through the intermediate, central tubular portion. Each of the tapering portions is then open from substantially the extreme ends of the body to the central body portion. In this configuration, the coat pack 10 may readily receive a coat, such as by permitting the user to reach through the pack with an arm and pull the coat into the pack along the longitudinal axis of the tube. The bulk of the coat is received in the central tubular portion, while the ends lie in the tapered portions. When the zippers 16 are pulled shut, the coat is contained in a compact and orderly manner that permits the coat to be carried close to the wearer's body.

The coat pack 10 lies close to the wearer's body when the pack is empty, also. The tubular body is able to collapse and lie flat like a close fitting apron across the seat and sides of the wearer. The tapered portions then angle upwardly toward the wearer's front and do not interfere with leg movement.

Figure 2:
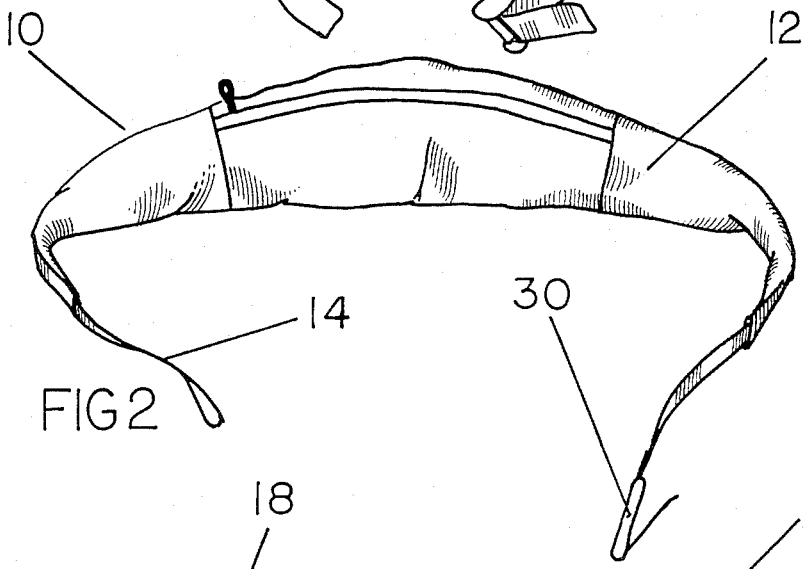
FIG. 2 is a left side view thereof.
Figure 3:
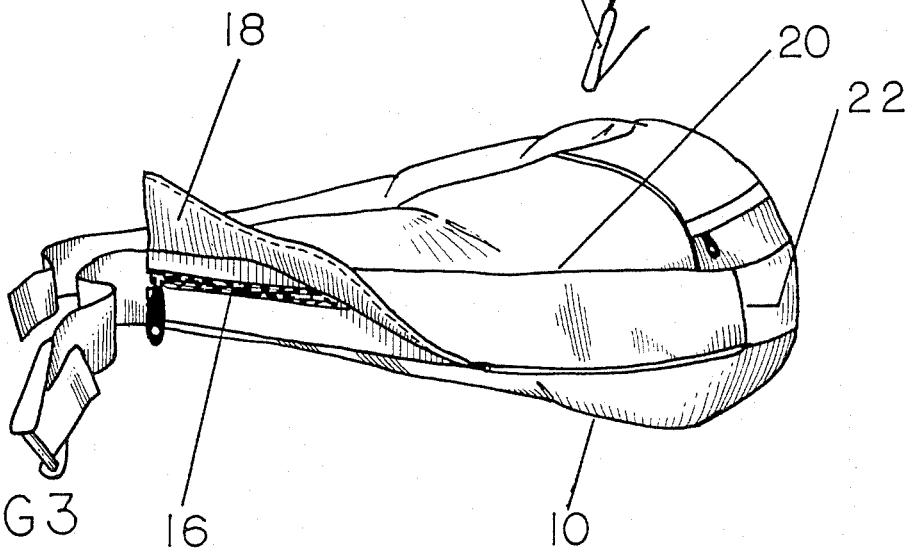
FIG. 3 is a top view thereof.

An additional feature of the coat pack is that the zippers 16 are covered with self-closing flaps to prevent entry of snow or rain through the closed zippers. As best shown in FIG. 2, the flaps cover the full length of each zipper. Each rectangular flap 18 is stitched along its top 20 and center-most end 22 so that the flap can be opened as the zipper is opened, but the flap will naturally tend to close over the zipper when the zipper is closed.

Figure 4:
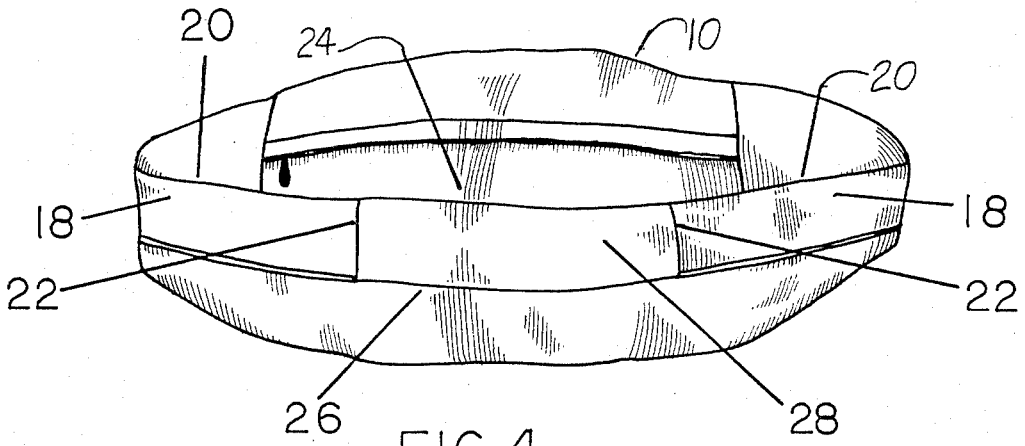
FIG. 4 is a rear view thereof.
Figure 6:
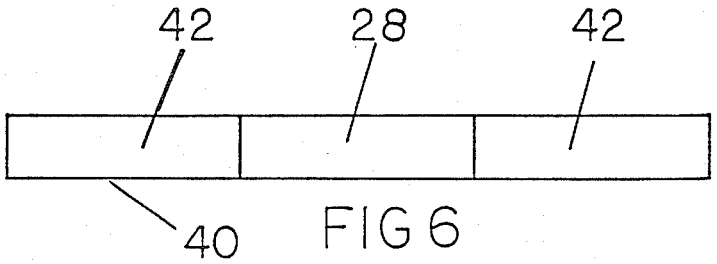
FIG. 6 is a plan view of a filler strip used to form the coat pack.
Figure 5:
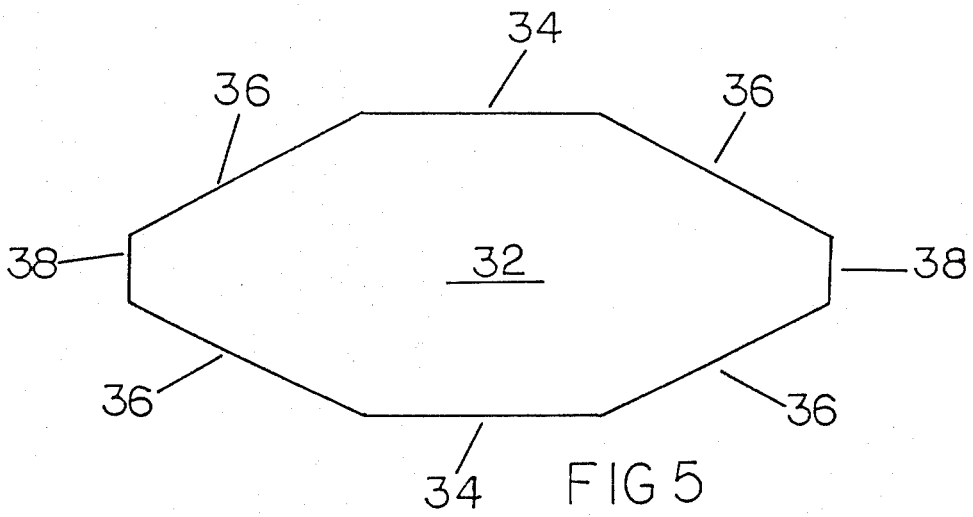
FIG. 5 is a plan view of the main panel of sheet material used to form the coat pack.

The manner of construction is best shown in FIGS. 4–6, where it can be seen that the tubular body is formed from sheet material such as a woven fabric joined at an upper major longitudinal seam 24 and a lower major longitudinal seam 26, FIG. 4, to a size panel 28. The coat pack thus formed may be joined at its opposite ends by a suitable fastener such as buckle 30, which may be on the ends of belt 14.

In greater detail, the construction includes a main panel of fabric 32, FIG. 5, in the approximate shape of a double trapezoid joined at a common base, the common base forming an elongated band adapted to be attached to the belt 14. The resulting flat figure has an upper seam edge and a lower seam edge 34 that define the approximate length of the central tubular portion of the body. From the seam edges 34, tapering edges 36 angle toward the outer ends of the flat figure and toward the common base. The edges 36 define the approximate longitudinal length of the tapering portions of the finished body. A pair of opposite belt edges 38 connect tapering edges 36 of the two trapezoids. The belt edges and the rectangle of sheet material between them serve as a mounting location of the belt 14.

A filler strip 28 has the same approximate longitudinal length as the main panel 32 between belt edges 38. The center portion of the filler strip is the previously referred to size panel 28, and the opposite end portions of the filler strip are the zipper and flap panels 42.

The coat pack is assembled by sewing the belt 14 across the main panel and over edges 38. The filler strip has the flaps stitched to the zipper panels. The main panel is then sewn to the filler strip, matching edges 34 against edges of the size panel and matching edges 36 against edges of the zipper panels. The resulting structure is the double-taper-ended tube 12 with a full length belt 14 as described above.

The invention has been described with particular reference to a specific embodiment; however, it will be understood that variations and modifications can be effected within the spirit and scope of the invention.

I claim:

1. A torso-encircling carrier, comprising:

an elongated tubular body having a tapering tubular body portion at each longitudinal end thereof, defining a substantially full-length continuous interior compartment between the opposite longitudinal ends and defining an arm-insertion passage means to said compartment in each of said tapering tubular body portions for, in use, permitting a user's arm to reach through the compartment and draw in an object to be carried in the compartment;

a closure means attached to each of said tapering tubular body portions for resealably opening said passages and permitting, in open condition, in use, through-passage of a carried object into said compartment between the opposite closure means; and fastening means for releasibly attaching the opposite ends of the body to form a closed figure wearable in a torso-encircling manner.

2. The carrier of claim 1, wherein said closure means comprise a zipper extending for substantially the full length of each tapering tubular body portion; and further comprising a central tubular body portion between said tapering tubular body portions, said central body portion maintaining the integrity of the tube when both of the zippers are open.

3. The carrier of claim 2, further comprising a flap over each of said zippers, said flaps being connected to the tubular body along two contiguous edges for causing the flaps to be urged to closed position overlying said zippers.

4. A torso-encircling carrier, comprising:

a longitudinally elongated tubular body having first and second opposite tapering tubular end portions and a central tubular interconnecting said end portions and defining therewith a continuous longitudinal inner compartment, said first and second end portions defining, respectively, first and second longitudinally elongated passage means that together provide through-passage of said inner compartment for permitting, in use, insertion of a user's arm sequentially through the first passage means, inner compartment, and second passage means for then grasping a cargo object, followed by retraction to pull the cargo object into the compartment;

first and second closure means connected, respectively, to first and second passage means for releasibly closing the respective passage means; and a torso-encircling belt connected along its central section to said tubular body and having mating fastening means at its opposite ends.

5. The torso-encircling carrier of claim 4, wherein said tubular body is formed from a panel of sheet material having the approximate shape of a double trapezoid having a common major base and opposite minor bases, wherein the major base is connected to and longitudinally aligned with said belt, the minor bases are connected, defining said central tubular portion, said first tubular end portion is defined by the triangular side portions of the double trapezoid at a first end of the major base, and said first passage means is defined by the angled side edges of the double trapezoid at said first end of the major base.

6. The torso-encircling carrier of claim 5, further comprising a filler strip connected between said minor bases of said double trapezoidal panel, wherein a pair of opposite end panels of said filler strip extend respectively over said first and second passage means and respectively cover said first and second closure means.

* * * * *